US007080464B1

(12) United States Patent
Tarnowski et al.

(10) Patent No.: US 7,080,464 B1
(45) Date of Patent: Jul. 25, 2006

(54) DETECTION OF SYNTHETIC FABRIC LOADS IN AN AUTOMATIC DRYER

(75) Inventors: David L. Tarnowski, Stevensville, MI (US); Mark F. Kendall, Effingham, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 17 days.

(21) Appl. No.: 11/032,539

(22) Filed: Jan. 10, 2005

(51) Int. Cl.
*F26B 3/00* (2006.01)

(52) U.S. Cl. ..... 34/493; 34/260; 34/549; 34/497; 34/495

(58) Field of Classification Search ..... 34/260, 34/60, 491, 493, 549, 550, 446, 481–485, 34/495, 497
See application file for complete search history.

(56) References Cited

U.S. PATENT DOCUMENTS

| | | | | |
|---|---|---|---|---|
| 4,763,425 | A * | 8/1988 | Grennan | 34/552 |
| 5,193,292 | A * | 3/1993 | Hart et al. | 34/491 |
| 6,446,357 | B1 | 9/2002 | Woerdehoff et al. | 34/491 |

* cited by examiner

*Primary Examiner*—Kenneth Rinehart
(74) *Attorney, Agent, or Firm*—John F. Colligan; Robert O. Rice; Stephen Krefman

(57) ABSTRACT

A method for detecting the presence of a synthetic fabric load during an automatic drying cycle in an automatic dryer avoids premature termination of the automatic drying cycle and ensures that the synthetic fabric items are dried according to a user's desired dryness level. The presence of the synthetic fabric load is detected by determining a duration of a first heating cycle, determining a duration of a second heating cycle, and determining the presence of the synthetic fabric load based on the durations of the first and the second heating cycles.

30 Claims, 4 Drawing Sheets

| | D-Value | | |
|---|---|---|---|
| Slight level of moisture detected? | D ≤ 40 s | 40s < D ≤ 90 s | D > 90 s |
| Yes | Not a synthetic load. Invoke current drying algorithm. | A small synthetic load size with high IMR, or large synthetic load size with low IMR. Invoke SFD "A". | A small synthetic load size of medium to high IMR. Invoke SFD "B". |
| No | Not a synthetic load. Use minimum run time algorithm. | A small synthetic load size with low or medium IMR. Invoke SFD "A". | A medium synthetic load size of medium to high IMR. Invoke SFD "B". |

Fig. 4

| Drying Cycle Parameters (Heater Off Time (sec)) | | | |
|---|---|---|---|
| | Dryness level setting | | |
| Algorithm Type | Less | Normal | More |
| SFD A | 240 | 500 | 700 |
| SFD B | 430 | 770 | 810 |

Fig. 5

DETECTION OF SYNTHETIC FABRIC LOADS IN AN AUTOMATIC DRYER

BACKGROUND OF THE INVENTION

1. Field of the Invention

The invention relates generally to automatic drying of synthetic fabric loads and more particularly to detecting a synthetic fabric load in an automatic dryer.

2. Description of the Related Art

Dryers are well-known appliances for drying clothing and other fabric items, such as towels, sheets, blankets, and the like. Most dryers comprise a rotating drum sized to receive a load of fabric items, a blower for forcing air through the drum, and a heater to heat the air as it flows through the dryer. Typically, dryers can be operated in a manual mode, wherein the user inputs a desired drying duration, or an automatic mode. In the automatic mode, the user enters inputs, such as fabric type (e.g., normal, permanent press, and delicate) and a desired dryness level (e.g., more, normal, and less), and a controller in the dryer runs a drying cycle according to the inputs. To ascertain the dryness level or, conversely, moisture content of the fabric items during the automatic mode, the dryer usually comprises a moisture sensor in the drum so that the fabric items contact the sensor as the drum rotates. An example of a moisture sensor is a pair of spaced electrodes on the interior surface of the drum. When a moist fabric item simultaneously contacts both sensors during what is commonly termed a "wet hit," the electrical circuit is completed, and the sensor sends a signal to the controller indicating that the fabric items are moist. The quantity of wet hits within a specified time period is translated into the moisture content of the fabric items, and the moisture content is monitored until the number of wet hits falls below a predetermined threshold value determined by the desired dryness level input by the user. When the number of wet hits is below the threshold value, the controller determines that the fabric items have achieved the desired dryness level or that the drum is empty, and the heating portion of the drying cycle ceases.

Automatic drying of fabric items is effective and efficient when the fabric items are comprised of natural fabrics, such as cotton. These fabrics dry evenly from the interior to the outer surfaces thereof, and, therefore, moisture sensors, which contact the outer surfaces of the fabric, can successfully detect the moisture content of the fabric items. Synthetic fabrics, however, can be problematic for conventional moisture sensors and are consequently difficult to dry during automatic drying cycles. During the initial stages of drying cycles, water tends to gravitate toward the interior of synthetic fabrics to leave the outer surfaces relatively dry. As a result, the synthetic fabrics with the dry outer surfaces do not register a wet hit on the moisture sensors even though the interior of the fabric can be moist. Consequently, the controller incorrectly deduces that the load has achieved the desired dryness level or that the drum is empty and prematurely terminates the automatic drying cycle. Thus, it is desirable for the automatic dryer to be able to detect the presence of a synthetic fabric load in order to execute a proper drying cycle.

SUMMARY OF THE INVENTION

A method according to the invention for detecting a synthetic fabric load in an automatic clothes dryer comprises determining a duration of a first heating cycle; determining a duration of a second heating cycle; and determining the presence of a synthetic fabric load based on the durations of the first and the second heating cycles.

The determination of the presence of the synthetic fabric load can comprise comparing the durations of the first and the second heating cycles. The comparing the durations of the first and second heating cycles can comprise calculating one of a ratio and a difference between the durations of the first and second heating cycles. The determination of the presence of the synthetic fabric load can comprise comparing the one of the ratio and the difference to at least one predetermined threshold value corresponding to the presence of the synthetic fabric load. The at least one predetermined threshold value can be empirical. The determination of the presence of the synthetic fabric load can comprise comparing the one of the ratio and the difference to at least one range of predetermined threshold values to characterize the fabric load. The at least one range of predetermined threshold values can be empirical. Characterizing the fabric load can comprise assessing load size.

Preferably, the second heating cycle immediately follows the first heating cycle. Each of the first and second heating cycles can comprise an increasing temperature period and a decreasing temperature period. The increasing temperature period begins when a temperature associated with the automatic clothes dryer achieves a predetermined low set point and terminates when the temperature achieves a predetermined high set point, and the decreasing temperature period begins when the temperature achieves the predetermined high set point and terminates when the temperature achieves the predetermined low set point. A heater of the automatic clothes dryer is active during the increasing temperature period and inactive during the decreasing temperature period. At least one of the low and high set point can be determined by a user selected automatic drying cycle.

The determination of the durations of the first and second heating cycles can comprise measuring a time during which a temperature associated with the automatic clothes dryer is above a predetermined low set point. The low set point can be determined by a user selected automatic drying cycle.

The method can further comprise selecting parameters for a drying cycle based on the outcome of the determination of the presence of the synthetic fabric load.

An automatic clothes dryer according to the invention for drying fabric items according to an automatic drying cycle comprises a drying chamber for receiving fabric items; an air circulation system for forcing air through the drying chamber; a heater for heating the air in the air circulation system; and a controller operably coupled to the heater for governing the heater through multiple heating cycles to implement the automatic drying cycle and comprising a timer for determining a duration of each heating cycle; wherein the controller detects the presence of a synthetic fabric load based on the durations of the heating cycles.

The controller can comprise a memory in which it stores a value representative of a duration for a first heating cycle and a value representative of a second heating cycle. The controller can compare the stored values representative of the durations of the first and the second heating cycles to detect the presence of the synthetic fabric load. The controller can calculate one of a ratio and a difference between the stored values representative of the durations of the first and second heating cycles when comparing the stored values representative of the durations of the first and second heating cycles. The controller can compare the one of the ratio and the difference to at least one predetermined threshold value corresponding to the presence of the synthetic fabric load and stored in its memory to detect the presence of the synthetic fabric load. The at least one predetermined threshold value can be empirical. The controller can compare the one of the ratio and the difference to at least one range of predetermined threshold values stored in its memory to characterize the fabric load. The at least one range of predetermined threshold values can correspond to a load size.

The automatic clothes dryer can further comprise a temperature sensor to detect a temperature associated with the automatic clothes dryer. The controller can have a predetermined low set point and a predetermined high set point stored in its memory and can govern the heater so that the temperature is between the predetermined low set point and the predetermined high set point during each of the first and second heating cycles. During each of the first and second heating cycles, the controller can activate the heater during an increasing temperature period to increase the temperature from the predetermined low set point to the predetermined high set point and deactivate the heater during a decreasing temperature period so that the temperature decreases from the predetermined high set point to the predetermined low set point. The controller can measure a time during which the temperature is above a predetermined low set point to determine the durations of each of the first and second heating cycles. The low set point can be determined by the automatic drying cycle.

The controller can select parameters for the automatic drying cycle based on the outcome of the detection of the presence of the synthetic fabric load.

BRIEF DESCRIPTION OF THE DRAWINGS

In the drawings:

FIG. 4 is a table showing characterization of dryer loads based on a comparison of a duration of the first heating cycle and a duration of the second heating cycle shown in FIG. 3.

FIG. 5 is a table of exemplary parameters of automatic drying cycles for synthetic fabric loads.

DESCRIPTION OF THE PREFERRED EMBODIMENT

Figure 1:
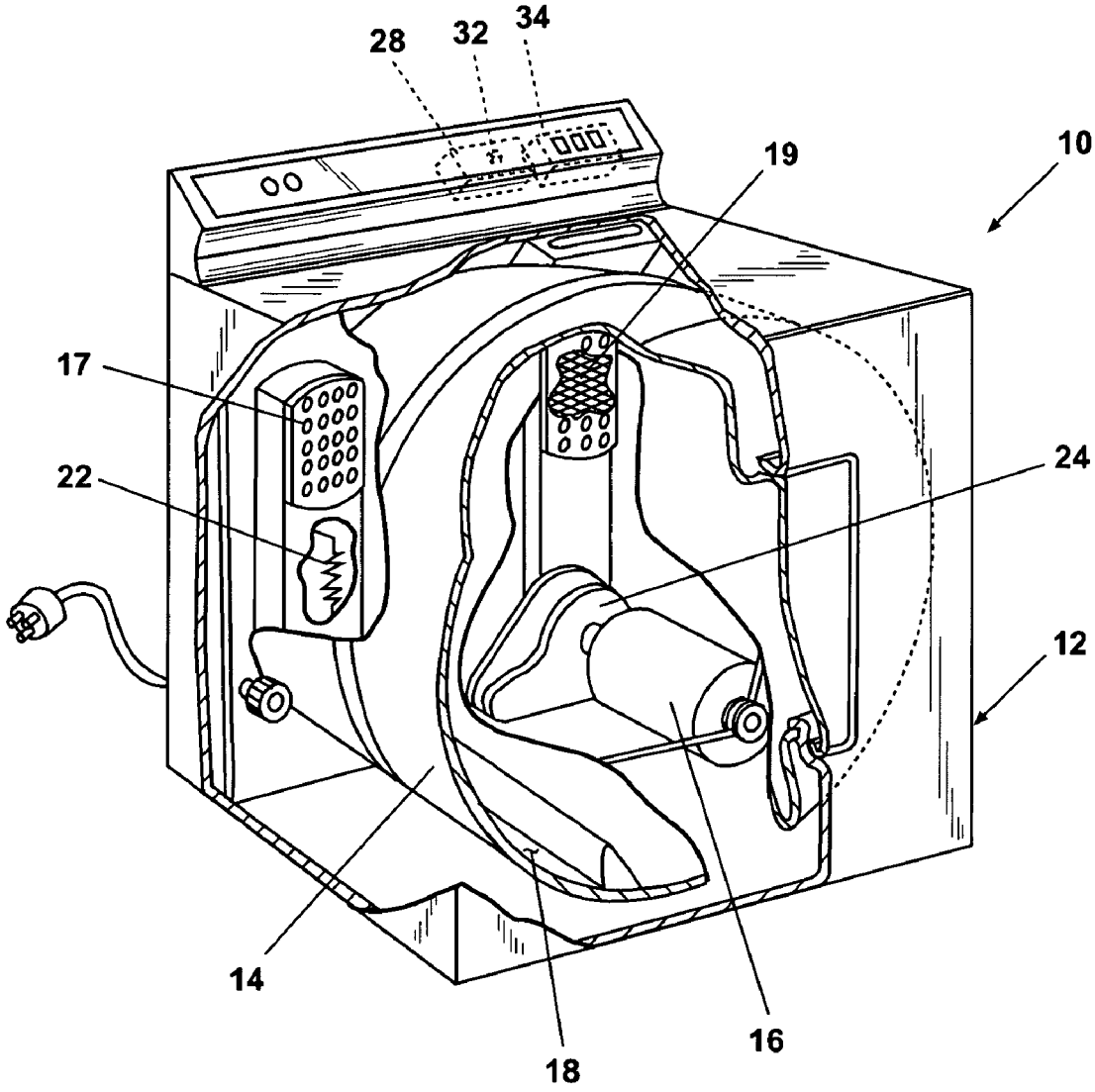
FIG. 1 is a partial cut away perspective view of an automatic dryer employing a controller to detect the presence of a synthetic fabric load according to the invention.
Figure 2:
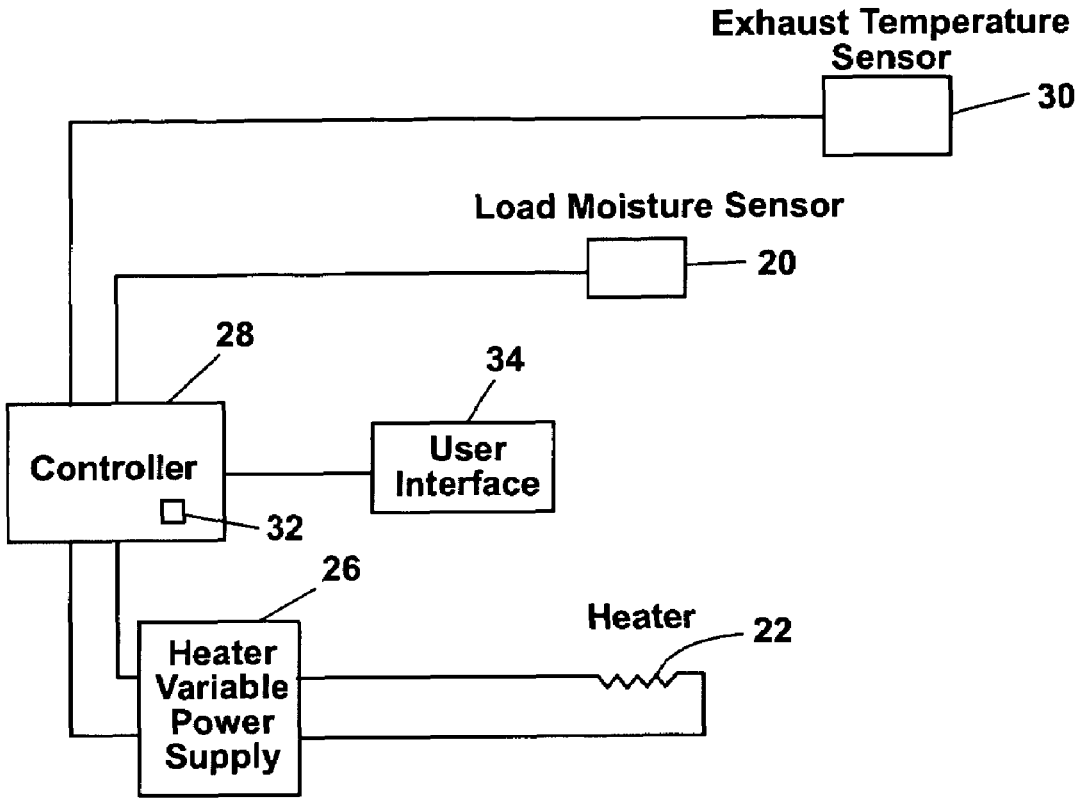
FIG. 2 is a block diagram of a control assembly of the automatic dryer of FIG. 1.

Referring now to the figures and particularly to FIGS. 1 and 2, an automatic dryer 10 according to the invention for drying clothing and other fabric items, such as towels, sheets, and blankets, comprises a cabinet 12 that houses a rotatable drum 14, which is driven by a motor 16. The drum 14 defines a drying chamber 18 having an inlet aperture 17 and an outlet aperture 19 and sized to receive a load of fabric items. Additionally, the drum 14 preferably includes at least one load moisture sensor 20 on an interior surface thereof to detect moist fabric items in the load as the drum 14 rotates. The dryer 10 further comprises a heater 22 and an air circulation system that typically includes a fan 24 for forcing air heated by the heater 22 through the drying chamber 18 to dry the fabric items held therein. The fan 24 is typically a blower driven by the motor 16 that rotates the drum 14. The heater 22 can be a single electrical heating element, a double electrical heating element, a gas heater, or any other suitable heating device. The heater 22 is selectively energized by a heater variable power supply 26 that is controlled by a controller 28. A temperature sensor 30 located downstream of the drying chamber 18 measures the temperature of exhaust air as or after it exits the drying chamber 18 and communicates the temperature to the controller 28. Alternatively, the temperature sensor 30 can be located elsewhere in the dryer 10 to measure the temperature of the air at another point in its circulation path. The controller 28, which includes a timer 32 and a memory, is connected to a user interface 34 for receiving inputs from the user and is operatively coupled with the motor 16 that rotates the drum 24 and drives the fan 24 and the heater variable power supply 26 that activates and deactivates the heater 22 to execute manual drying cycles and automatic drying cycles input by the user through the user interface 34.

The manual drying cycle is a drying cycle having a fixed duration as set by the user through the user interface 32. The user estimates a drying time based on, for example, a desired dryness level, load size, and previous experience. The automatic drying cycle, conversely, runs according to programmed algorithms selected based on user inputs related to the load, such as load type and size, and desired dryness level of the load and executed by the controller 28. Examples of load type include, but are not limited to, casual, permanent press, heavy duty, and delicate, and load sizes can be characterized as, for example, extra large, large, medium, small, and extra small. Exemplary dryness levels for fabrics include more (bone-dry), normal, and less and are qualitative descriptors corresponding to a desired output of the dryer 10. The controller 28 also utilizes data provided by the moisture sensor 20, the temperature sensor 30, and the timer 32, as schematically illustrated in FIG. 2, during the automatic drying cycle to execute and, if necessary, alter the automatic drying cycle that is selected based on the user inputs. An example of controlling automatic drying cycles in a dryer is disclosed in U.S. Pat. No. 6,446,357, which is incorporated herein by reference in its entirety.

Figure 3:
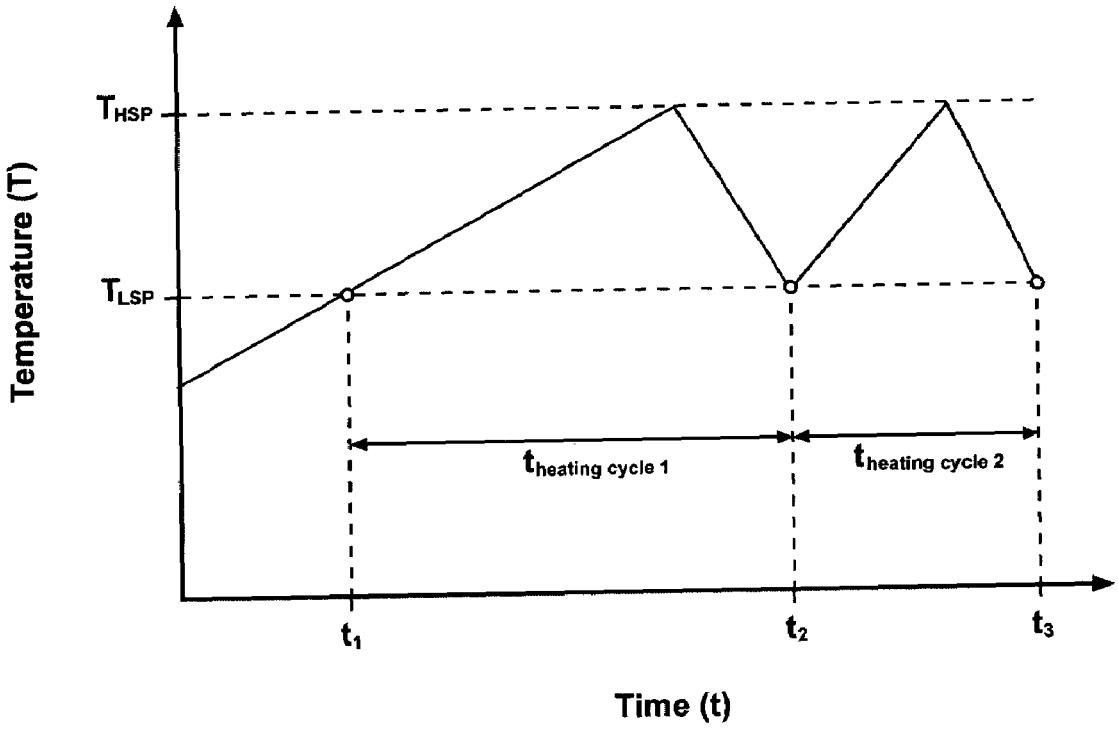
FIG. 3 is a graph schematically illustrating a first heating cycle and a second heating cycle of an automatic drying cycle for the automatic dryer of FIG. 1.

According to the present invention, the automatic drying cycle comprises an initial series of multiple heating cycles, as illustrated in FIG. 3, wherein the controller 28 instructs the variable heater power supply 36 to selectively activate and deactivate the heater 22 to vary the temperature sensed by the temperature sensor 30 between a low set point ($T_{LSP}$) and a high set point ($T_{HSP}$), which are determined by the inputs entered by the user through the user interface 34 and stored in the memory of the controller 28. Each heating cycle comprises an increasing temperature period, wherein the heater 22 is active and the temperature increases from the $T_{LSP}$ to the $T_{HSP}$, and a decreasing temperature period, wherein the heater 22 is inactive and the temperature decreases from the $T_{HSP}$ to the $T_{LSP}$. As shown in FIG. 3, when the heater 22 initially activates, the temperature first increases from below the $T_{LSP}$ to the $T_{LSP}$ before a first heating cycle begins. This occurs because the exhaust temperature is initially closer to or equal to the ambient temperature, and the ambient temperature is significantly less than the $T_{LSP}$. As the first heating cycle continues, the temperature increases from $T_{LSP}$ to $T_{HSP}$, and then the heater 22 is deactivated such that the temperature decreases to $T_{LSP}$. When the first heating cycle terminates at $T_{LSP}$, the heater 22 immediately activates to begin a second heating cycle. During the heating cycles, the timer 32 measures the times at which the temperature equals $T_{LSP}$ so that the timer 32 or the controller 28 can calculate the duration of a heating cycle or a value representative of the duration of each heating cycle, which is stored in the memory of the controller 28. The duration is the time t elapsed between the beginning of the heating cycle when the temperature equals $T_{LSP}$ and the end of the heating cycle when the temperature is again equal to $T_{LSP}$. For example, in FIG. 3, the duration of the first heating cycle $t_{heating\ cycle\ 1}$ is the time elapsed between $t_1$ and $t_2$, and the duration of the second heating cycle $t_{heating\ cycle\ 2}$ is the time elapsed between $t_2$ and $t_3$. The duration of the heating cycles can be constant or variable, depending on the type of load in the dryer 10. The number of heating cycles in the initial series is determined by the user inputs and the automatic drying cycle, and the first heating cycle and the second heating cycle that preferably immediately follows the first heating cycle can be employed to detect a presence of a synthetic fabric load, which is a load consisting primarily of synthetic fabric items.

The relationship between the durations of first heating cycle and the second heating cycle is distinct for synthetic fabric loads and can be used to detect the presence of such loads. By comparing the durations of the first cycle and the second heating cycle, as measured by the timer 32, the controller 28 can identify whether the load is a synthetic fabric load or a load/operating condition for which the synthetic fabric load is commonly mistaken, such as a normal dry load or an empty drum, as described in the background of the invention. When the moisture sensor 20 registers very few or no wet hits, the controller 28 can scrutinize the relationship between the first heating cycle and the second heating cycle to determine whether the load is truly dry/the drum 14 is empty or whether the load is a synthetic fabric load.

As illustrated in FIG. 3, the duration of the second heating cycle is significantly less than that of the first heating cycle. The relationship can be quantified in any suitable manner, such as by calculating a difference D between the duration of the first heating cycle and the duration of the second heating cycle. In general, the greater the D value, the more likely the load contains mostly or all synthetic fabric items. The D value is compared to a predetermined threshold value or a range of predetermined threshold values, which are stored in the memory of the controller 28, to determine whether the load is a synthetic fabric load. The threshold values are determined empirically and depend on several variables related to the dryer 10, such as the type of heater 22 and the power supplied to the heater 22, and can vary for different dryers and different types of dryers. The threshold value can define a single cut-off value above which the load is characterized as a synthetic fabric load, or several threshold values can define ranges corresponding to various types of synthetic loads. For example, it has been determined that the magnitude of the D value above a threshold value indicates a size of the synthetic load. Thus, the D value can provide information related to fabric type and load size. Further, the D value can be used in conjunction with information provided by the moisture sensor 20 to characterize the load. For example, if the moisture sensor 20 detects a few wet hits compared to zero wet hits, the controller 28 can use this information to make inferences related to load size and initial moisture retention (initial moisture content) of the fabric items in the load.

An exemplary table for characterizing loads having few or zero wet hits on the moisture sensor 20 in the dryer 10 is shown in FIG. 4. As stated previously, the threshold values for load characterization are empirical. The D values presented in the table are for exemplary purposes only, and other D values can be suitable for other dryers. According to this example, if the D value is less than or equal to forty, then the load is not a synthetic fabric load, and the remainder of the automatic drying cycle is executed in a manner that depends on whether the moisture sensor 20 registers any wet hits. If the moisture sensor 20 senses wet hits, the controller 28 runs the current drying algorithm for non-synthetic fabric loads. If no wet hits are registered and the D value is less than 40, then the controller 28 determines that the drum 14 is empty or a dry rack is in use (wherein the fabric items do not contact the interior of the drum 14), and the controller 28 consequently invokes an alternative minimum run time routine. If the D value is greater than 40, then the controller 28 determines that the load is a synthetic fabric load and characterizes the synthetic fabric load based on the magnitude of the D value and the presence or absence of wet hits registered by the moisture sensor 20, as shown in the two rightmost columns in the table of FIG. 4. In particular, the controller 28 uses this information to assign the load size and the initial moisture retention.

Once the controller 28 determines that the load is a synthetic fabric load, the controller 28 selects suitable automatic drying cycle parameters, such as suitable algorithms and/or algorithm parameters, for executing the remainder of the automatic drying cycle. The parameters and algorithms are pre-programmed into the controller 28 and are empirically determined for achieving a desired dryness of the synthetic fabric load. Similar to the above described threshold values, the parameters and algorithms can vary for different types of dryers.

An exemplary table of automatic drying cycle parameters for synthetic fabric loads characterized according to the table of FIG. 4 is shown in FIG. 5. Depending on the D value and the detection of wet hits by the moisture sensor 20, the controller 28 invokes either a Synthetic Fabric Drying (SFD) "A" algorithm or a SFD "B" algorithm. In this example, the drying time is determined by a total elapsed time that the heater 22 is inactive and depends on the dryness level selected by the user. As seen in FIG. 5, the total elapsed inactive heater time for the SFD "A" algorithm is less than that for the SFD "B" algorithm, and, therefore, the former is invoked with small synthetic fabric loads of low, medium, or high initial moisture retention and medium and large synthetic fabric loads of low initial moisture retention, while the latter is employed with medium and large synthetic fabric loads of medium to high initial moisture retention. Again, these characterizations and automatic drying cycle parameters are shown for exemplary purposes only, and the actual values and algorithms can differ from those in the tables and can vary for different dryers. Further, the drying time can be calculated in numerous ways. For example, the drying time can be based on the D value alone or can determined by a counting the number of times the heater is inactive, by referring to a look-up table of predetermined drying time values, or by any other suitable manner well-known to one skilled in the automatic dryer art.

In operation, a user fills the drum 14 with a synthetic fabric load, selects the automatic drying cycle, and enters user inputs, such as the desired dryness level and the load size, through the user interface 34. When the automatic drying cycle begins, the controller 28 activates the heater 22 to begin the heating cycles, the temperature sensor 30 detects the exhaust temperature and communicates the temperature with the controller 28, and the moisture sensor 20 register wet hits, if any, from the synthetic fabric load and communicates them to the controller 28. If few or no wet hits are detected, then the controller 28 evaluates the relationship between the first heating cycle and the second heating cycle, as described in detail above, such as by calculating the D value. The controller 28 then compares the D value to the threshold value or the range of threshold values, such as those presented in FIG. 4, to characterize the load. After the load is deemed a synthetic fabric load, then the controller invokes the suitable automatic drying cycle parameters/algorithms, such as those presented in FIG. 5, to execute the remainder of the automatic drying cycle. If the load is not a synthetic fabric load and generates few or no wet hits, the controller 28 identifies the non-synthetic fabric as such when comparing the D value with the threshold value or the range of threshold values. However, by detecting the presence of the synthetic fabric load, premature termination of the automatic drying cycle is prevented.

An alterative method of analyzing the relationship between the first heating cycle and the second heating cycle is calculation of a ratio R. R can have any suitable form, and exemplary formulas for R include:

$$R=t_{heating\ cycle\ 1}/t_{heating\ cycle\ 2} \text{ (or the inverse thereof);}$$

$$R=t_{heating\ cycle\ 1}/(t_{heating\ cycle\ 1}+t_{heating\ cycle\ 2});$$

$$R=t_{heating\ cycle\ 2}/(t_{heating\ cycle\ 1}+t_{heating\ cycle\ 2}); \text{ and}$$

$$R=D/(t_{heating\ cycle\ 1}+t_{heating\ cycle\ 2});$$

where $t_{heating\ cycle\ 1}$=duration of the first heating cycle;

$t_{heating\ cycle\ 2}$=duration of the second heating cycle; and $$D=t_{heating\ cycle\ 1}-t_{heating\ cycle\ 2}.$$

When the ratio R is utilized to detect the presence of a synthetic fabric load, the threshold values are adjusted according to the particular formula employed to calculate R.

In the above description of the invention, the term "synthetic fabric load" has been used to refer to a load comprising primarily items made of synthetic fabrics. The load can include one or more non-synthetic fabric items. The invention is intended to eliminate premature termination of the automatic drying cycle due to misinterpretation of the information provided by the moisture sensor 20 to the controller 28. Thus, the synthetic fabric load is intended to be any load having an amount or concentration of synthetic fabric items that is sufficient to lead to the premature termination of the automatic drying cycle due to interaction of the load with the moisture sensor 20 and incorrect interpretation of the information provided to the controller 28 based on this interaction.

Additionally, the heater 22 is described above as a single electrical heating element, a double electrical heating element, a gas heater, or any other suitable heating device. When the heater 22 is a double element heater, the heater 22 is preferably controlled like a single element heater during at least the first two heating cycles to obtain the D value or other measurement of the relationship between the first heating cycle and the second heating cycle. Thereafter, the heater 22 can be controlled in a manner to optimize the benefits of dual-element heating.

The invention provides a robust and accurate method of detecting the presence of a synthetic fabric load in an automatic dryer. To implement the method, the dryer utilizes existing hardware and, therefore, does not require any additional cost. By detecting the presence of the automatic fabric load, the automatic dryer avoids premature termination of the automatic drying cycle and ensures that the synthetic fabric load is dried to the user's desired dryness level.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method for detecting a synthetic fabric load in an automatic clothes dryer, the method comprising:

determining a duration of a first heating cycle;

determining a duration of a second heating cycle; and determining the presence of a synthetic fabric load based on the durations of the first and the second heating cycles.

2. The method according to claim 1, wherein the determination of the presence of the synthetic fabric load comprises comparing the durations of the first and the second heating cycles.

3. The method according to claim 2, wherein the comparing the durations of the first and second heating cycles comprises calculating one of a ratio and a difference between the durations of the first and second heating cycles.

4. The method according to claim 3, wherein the determination of the presence of the synthetic fabric load comprises comparing the one of the ratio and the difference to at least one predetermined threshold value corresponding to the presence of the synthetic fabric load.

5. The method according to claim 4, wherein the at least one predetermined threshold value is empirical.

6. The method according to claim 3, wherein the determination of the presence of the synthetic fabric load comprises comparing the one of the ratio and the difference to at least one range of predetermined threshold values to characterize the fabric load.

7. The method according to claim 6, wherein characterizing the fabric load comprises assessing load size.

8. The method according to claim 6, wherein the at least one range of predetermined threshold values is empirical.

9. The method according to claim 1, wherein the second heating cycle immediately follows the first heating cycle.

10. The method according to claim 1, wherein each of the first and second heating cycles comprises an increasing temperature period and a decreasing temperature period.

11. The method according to claim 10, wherein the increasing temperature period begins when a temperature associated with the automatic clothes dryer achieves a predetermined low set point and terminates when the temperature achieves a predetermined high set point, and the decreasing temperature period begins when the temperature achieves the predetermined high set point and terminates when the temperature achieves the predetermined low set point.

12. The method according to claim 11, wherein a heater of the automatic clothes dryer is active during the increasing temperature period and inactive during the decreasing temperature period.

13. The method according to claim 11, wherein at least one of the low and high set point is determined by a user selected automatic drying cycle.

14. The method according to claim 1, wherein the determination of the durations of the first and second heating cycles comprises measuring a time during which a temperature associated with the automatic clothes dryer is above a predetermined low set point.

15. The method according to claim 14, wherein the low set point is determined by a user selected automatic drying cycle.

16. The method according to claim 1 and further comprising selecting parameters for a drying cycle based on the outcome of the determination of the presence of the synthetic fabric load.

17. An automatic clothes dryer for drying fabric items according to an automatic drying cycle, the dryer comprising:

a drying chamber for receiving fabric items;

an air circulation system for forcing air through the drying chamber;

a heater for heating the air in the air circulation system; and a controller operably coupled to the heater for governing the heater through multiple heating cycles to implement the automatic drying cycle and comprising a timer for determining a duration of each heating cycle;

wherein the controller detects the presence of a synthetic fabric load based on the durations of the heating cycles.

18. The automatic clothes dryer according to claim 17, wherein the controller comprises a memory in which it stores a value representative of a duration for a first heating cycle and a value representative of a second heating cycle.

19. The automatic clothes dryer according to claim 18, wherein the controller compares the stored values representative of the durations of the first and the second heating cycles to detect the presence of the synthetic fabric load.

20. The automatic clothes dryer according to claim 19, wherein the controller calculates one of a ratio and a difference between the stored values representative of the durations of the first and second heating cycles when comparing the stored values representative of the durations of the first and second heating cycles.

21. The automatic clothes dryer according to claim 20, wherein the controller compares the one of the ratio and the difference to at least one predetermined threshold value corresponding to the presence of the synthetic fabric load and stored in its memory to detect the presence of the synthetic fabric load.

22. The automatic clothes dryer according to claim 21, wherein the at least one predetermined threshold value is empirical.

23. The automatic clothes dryer according to claim 20, wherein the controller compares the one of the ratio and the difference to at least one range of predetermined threshold values stored in its memory to characterize the fabric load.

24. The automatic clothes dryer according to claim 23, wherein the at least one range of predetermined threshold values corresponds to a load size.

25. The automatic clothes dryer according to claim 18 and further comprising a temperature sensor to detect a temperature associated with the automatic clothes dryer.

26. The automatic clothes dryer according to claim 25, wherein the controller has a predetermined low set point and a predetermined high set point stored in its memory and governs the heater so that the temperature is between the predetermined low set point and the predetermined high set point during each of the first and second heating cycles.

27. The automatic clothes dryer according to claim 26, wherein during each of the first and second heating cycles, the controller activates the heater during an increasing temperature period to increase the temperature from the predetermined low set point to the predetermined high set point and deactivates the heater during a decreasing temperature period so that the temperature decreases from the predetermined high set point to the predetermined low set point.

28. The automatic clothes dryer according to claim 25, wherein the controller measures a time during which the temperature is above a predetermined low set point to determine the durations of each of the first and second heating cycles.

29. The automatic clothes dryer according to claim 28, wherein the low set point is determined by the automatic drying cycle.

30. The automatic clothes dryer according to claim 17, wherein the controller selects parameters for the automatic drying cycle based on the outcome of the detection of the presence of the synthetic fabric load.

* * * * *